US006120420A

United States Patent [19]

Pearson et al.

[11] Patent Number: 6,120,420

[45] **Date of Patent: *Sep. 19, 2000**

[54] EXERCISE DEVICE

[75] Inventors: Bruce E. Pearson; Philip E. Hoggard, both of Searcy, Ark.

[73] Assignee: Mass Production, Inc., Searcy, Ark.

[ * ] Notice: This patent issued on a continued prosecution application filed under 37 CFR 1.53(d), and is subject to the twenty year patent term provisions of 35 U.S.C. 154(a)(2).

[21] Appl. No.: 09/268,947

[22] Filed: Mar. 16, 1999

[51] Int. Cl.[7] ..... A63B 21/072

[52] U.S. Cl. ..... 482/108; 482/106

[58] Field of Search ..... 482/50, 93, 106–108, 482/109

[56] References Cited

U.S. PATENT DOCUMENTS

| | | | |
|---|---|---|---|
| 702,356 | 6/1902 | Calvert . | |
| 990,791 | 4/1911 | Whitley et al. | 482/108 |
| 1,044,018 | 11/1912 | Calvert . | |
| 3,171,652 | 3/1965 | Newman . | |
| 3,334,899 | 8/1967 | Bosko et al. . | |
| 3,464,692 | 9/1969 | Ammondson et al. . | |
| 3,482,834 | 12/1969 | James, Jr. . | |
| 3,488,051 | 1/1970 | Papistas-Scherer | 482/108 |
| 4,361,324 | 11/1982 | Baroi | 482/108 |
| 4,455,023 | 6/1984 | Saloom | 482/109 |
| 4,538,806 | 9/1985 | Wilkerson . | |
| 4,830,364 | 5/1989 | Wexler . | |
| 5,102,124 | 4/1992 | Diodati . | |
| 5,242,350 | 9/1993 | Chang | 482/108 |
| 5,897,469 | 4/1999 | Yalch | 482/106 X |

OTHER PUBLICATIONS

Body Builder's Discount Outlet, Summer 1995 Catalog, p. 34 (Fixed Weight Sets).

*Primary Examiner*—John Mulcahy
*Attorney, Agent, or Firm*—J. Charles Dougherty

[57] ABSTRACT

An exercise device having weighted heads is disclosed. The weighted heads are composed of a light shell with a heavy core. The combination of a durable but light shell material with a denser core material results in weighted heads with reduced bulk. The reduced bulk improves the user's control of the device during use, reduces anatomical stress to the users arms and hands, and allows the user to lift a greater amount of weight while maintaining control of the device.

13 Claims, 2 Drawing Sheets

16
16
20
28
20
24
10
22
14
12
12

16
24
10
28
20
26
14
22
12

EXERCISE DEVICE

BACKGROUND OF THE INVENTION

The present invention relates generally to exercise devices, and in particular to devices used for weight training and weight lifting, such as barbells and dumbbells.

Conventional dumbbells and barbells consist of a handle with a weighted head attached at or near either end. The weighted heads may be in the form of circular plates. These circular plates are typically removable so that different or additional weighted heads may be attached as desired to vary the weight of the device. The weighted heads may also be permanently attached to the handle, or may be an integral part of the handle, as is often the case for dumbbells. Removable weighted heads are commonly in the form of cast iron plates with holes in the center to receive the handle. Permanently attached weighted heads are often made of iron, and in some cases the entire handle and weighted head assembly is formed of a single piece of material. Both removable plates and permanently attached weighted heads may be coated with a resilient material, such as vinyl, urethane, or rubber, to prevent marring of floors and other surfaces. Such coatings also help alleviate the noise that otherwise would result from the banging of the weighted heads against other equipment.

One of the chief disadvantages of conventional barbells and dumbbells is the size or bulk of the weighted heads. Large weighted heads make a barbell or dumbbell more difficult to balance and control. Thus the devices become more dangerous as the amount of weight is increased, since a person can easily lose control and drop the device. Also, the difficulty of controlling such devices lessens the maximum lifting capacity for a particular user, since the user must expend more energy to maintain balance and control over the device. The difficulty inherent in balancing and controlling a device with bulky weighted heads also increases the anatomical stress in the hands and arms of the user, thus increasing the risk of injury during exercise.

Iron or steel is typically chosen as the construction material for the weighted heads of barbells and dumbbells for several reasons. First, iron and steel are strong and durable, which extends the life of the weighted heads. Dumbbells and barbells are often used in a rough manner, and are commonly dropped or banged against other equipment. Durability is thus an essential requirement for these devices, particularly for devices designed to be used in commercial gymnasiums where heavy use is expected.

Another advantage of iron and steel is that these materials have a more attractive appearance than many other metals. This is particularly true of stainless steel. The exercise equipment market is extremely competitive, and commercially successful equipment must be not only functional but aesthetically pleasing to the user. Attractive exercise equipment encourages the user to continue with an exercise regimen, which is particularly important for those users who are not otherwise accustomed to weight training and weight lifting. Gymnasium and health club owners find that the aesthetic appearance of their equipment is significant in maintaining current members and attracting new members.

Although iron and steel have numerous advantages, they have certain disadvantages as well. Because iron and steel are relatively light metals, a weighted head constructed of these materials must be relatively large and bulky to impart a desired amount of weight. Also, although stainless steel is perhaps the most attractive material used in constructing such devices, it is extremely expensive, and thus dumbbells and barbells constructed of solid stainless steel would not be affordable by most consumers.

While it would be possible to construct weighted heads of heavier metals, such as lead for example, these metals also have undesirable qualities. In the case of lead, the softness and malleability of the metal makes construction with this material impractical. A weighted head constructed of solid lead would quickly deform during use, since such devices are commonly dropped or struck against other equipment. Moreover, lead has an unattractive appearance that would make such a device commercially unfeasible. It would therefore be desirable to develop an exercise device with weighted heads having the durability and attractiveness of a lighter material, yet also having the reduced bulk of a heavier material, thereby improving safety and increasing the user's lifting capacity.

The prior art includes a number of exercise devices comprising shells that are filled with material to impart weight. U.S. Pat. No. 1,044,018 to Calvert discloses a dumbbell and barbell having spherical heads filled with shot. U.S. Pat. No. 702,356, also to Calvert, discloses a barbell with shot-filled heads having an adjustable end plate to vary the amount of weight in each head. U.S. Pat. No. 3,334,899 to Bosko et al. discloses a dumbbell with spherical heads containing fluid. U.S. Pat. No. 4,538,806 to Wilkerson discloses a dumbbell having heads composed of a resilient material and filled with small balls, shot, a liquid, or gelatin. None of these disclosures specifically teach a device having weighted heads that are durable and attractive, yet also have the reduced bulk made possible only through the use of very dense materials. Also, since each of these devices has loose or fluid weighted material inside the weighted heads, there is always the risk of leakage or spillage of those materials.

U.S. Pat. No. 5,102,124 to Diodati discloses a barbell having weighted units composed of a plastic exterior with a weight material inside, where the weight material can be sand, cement, or a metal-based material. Diodati discloses that the weight material need not have structural strength or an attractive appearance. Diodati discloses, however, that the barbell has mounting portions in which the weighted units are placed. These mounting portions significantly increase the bulk of the disclosed barbell, and thus fail to achieve the desired object of reduced bulk as discussed above.

U.S. Pat. No. 3,464,692, 3,482,834, and 3,171,652, to Ammondson, et al., James, Jr., and Newman, respectively, each disclose dumbbells or weighted heads consisting of plastic shells filled with a liquid or solidified material such as cement. Weighted heads of this type lack the aesthetically pleasing appearance of iron or steel weighted heads. Prolonged or rough use can cause the plastic shell of these weighted heads to crack, particularly in commercial gymnasium environments. Also, the disclosed devices must include a plug that seals the aperture through which the filler material is poured into the plastic shell. These plugs may extend from the plastic shell, and thus may catch on clothing or equipment thereby creating a safety hazard. The plugs themselves degrade the symmetrically pleasing appearance of the dumbbell or barbell and thereby reduce the aesthetic qualities of the device. Finally, cement within such devices tends to crack during use and rattle inside the plastic shell, causing the devices to be noisy during exercise.

In short, none of the disclosures discussed above teach a device with weighted heads having the durability and attractiveness of a lighter material with the reduced bulk of a heavier material. Each of the disclosures teaches a device that has weighted elements that may shift, break, or leak during use. Liquid- and gelatin-filled devices are prone to leaking, while devices filled with shot may spill shot through prolonged use. Shot-filled devices are noisy as the shot moves within the device. Devices filled with concrete exhibit similar problems as the concrete cracks during use.

SUMMARY OF THE INVENTION

The present invention solves the problems encountered in the prior art by using weighted heads composed of a rigid, light shell that entirely encase a heavier core. The lighter shell material has the durability necessary to protect the weighted heads when the device is dropped or banged into other equipment, and also has the attractive appearance desired by users. By filling the lighter rigid shell with a solid core material that is heavier, the bulk of the weighted heads may be significantly reduced. It is believed that, depending upon the materials used, the bulk of the weighted heads can be reduced by 20–50% as compared to traditional all-steel weighted heads. This bulk reduction allows gym owners to better utilize gym space since the equipment will occupy less space both when racked and when in use. This space-saving feature also makes the devices more desirable for home users for whom storage space is typically an important concern. Reduced bulk also improves the safety of the exercise device because the user is more able to control less bulky dumbbells and barbells. The user may lift more weight using such a device since less energy is expended keeping the device under control during lifting. The anatomical stress on the users hands and arms is lessened because the user may more easily control an equivalent amount of weight due to the reduced bulk. Finally, since the present invention is directed to a device in which the lighter shell entirely encases the heavy material, there is no risk of leaking, breaking or shifting of the heavier material within the lighter rigid shell.

The device may be constructed, for example, as a dumbbell or barbell with weighted heads. Like other barbells and dumbbells, the present invention (or just the weighted heads thereof may be enclosed in a resilient material to protect floors and other equipment, and to reduce the noise resulting from the device banging into other equipment during use. Such resilient material may also be applied in strips to reduce cost.

It is therefore an object of the present invention to provide for an exercise device having durable weighted heads.

It is a further object of the present invention to provide for an exercise device having an attractive appearance to encourage use.

It is also an object of the present invention to provide an exercise device having weighted heads with reduced bulk for a given amount of weight.

It is also an object of the present invention to provide an exercise device that takes up less space when in use and when in storage than comparable devices with a comparable amount of weight.

It is also an object of the present invention to provide an exercise device allowing the user to expend less energy to balance and control the device.

It is also an object of the present invention to provide an exercise device that reduces the anatomical stress on the user's hands and arms during use.

It is also an object of the present invention to provide an exercise device that integrates a heavier material within a lighter outer shell to prevent leaking, shifting, or breaking of the heavier material.

These and other objects and advantages of the present invention will be apparent from a consideration of the following detailed description of the preferred embodiments in conjunction with the appended drawings as described following.

DETAILED DESCRIPTION OF THE PREFERRED EMBODIMENTS

Figure 1:
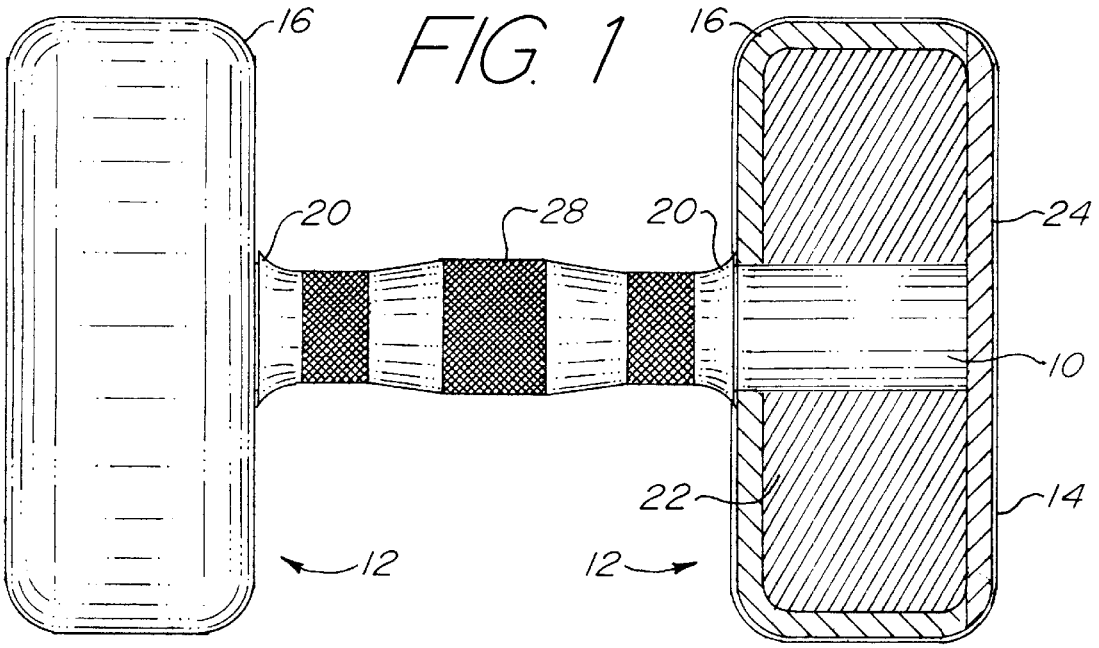
FIG. 1 is a cut-away elevational view of a preferred embodiment of the present invention.
Figure 2:
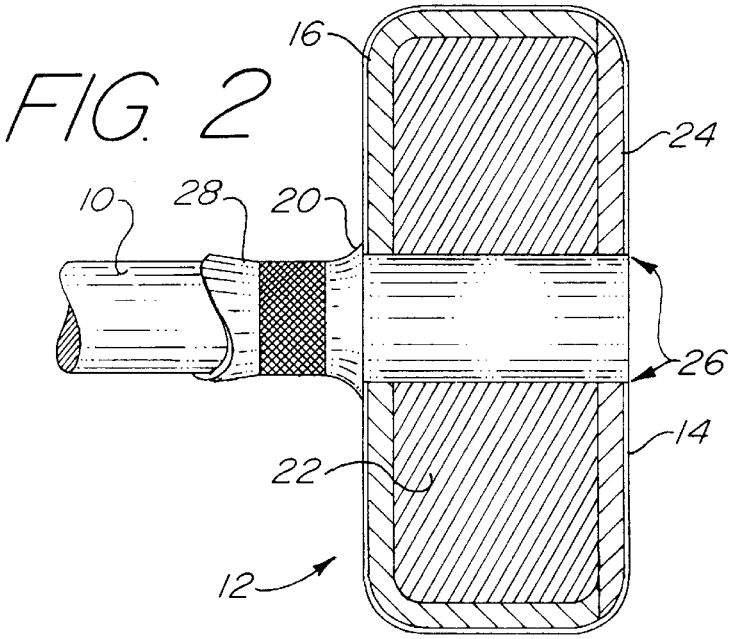
FIG. 2 is a partial cut-away elevational view of a second preferred embodiment of the present invention.

With reference to FIGS. 1 and 2, a preferred embodiment of the present invention in the form of a dumbbell may be described. The device consists of a handle 10 that preferably is formed of a solid material, but may also be hollow. Stainless steel is the preferred material for handle 10, but it may be formed of any suitably rigid material. Slid onto handle 10 is grip 28, which is preferably ergonomically shaped and knurled for the best fit with a user's hand. Note that in the preferred embodiment the handle 10 is a dumbbell handle, that is, the handle is designed for one-handed use, but the invention also contemplates a barbell, or two-handed version, as well.

On each end of handle 10 is a weighted head 12. Weighted heads 12 are preferably covered in a protective coating 14. Protective coating 14 may be a resilient or plastic material, such as urethane, vinyl, or rubber. Protective coating 14 is applied to protect the gymnasium floor or other surfaces, as well as other equipment, when the device is in use. Protective coating 14 also reduces the noise resulting from the device banging into other equipment, particularly metal equipment. In an alternative embodiment, protective coating 14 may be applied to less than all of the surface area of weighted heads 12 to reduce cost.

Figure 3:
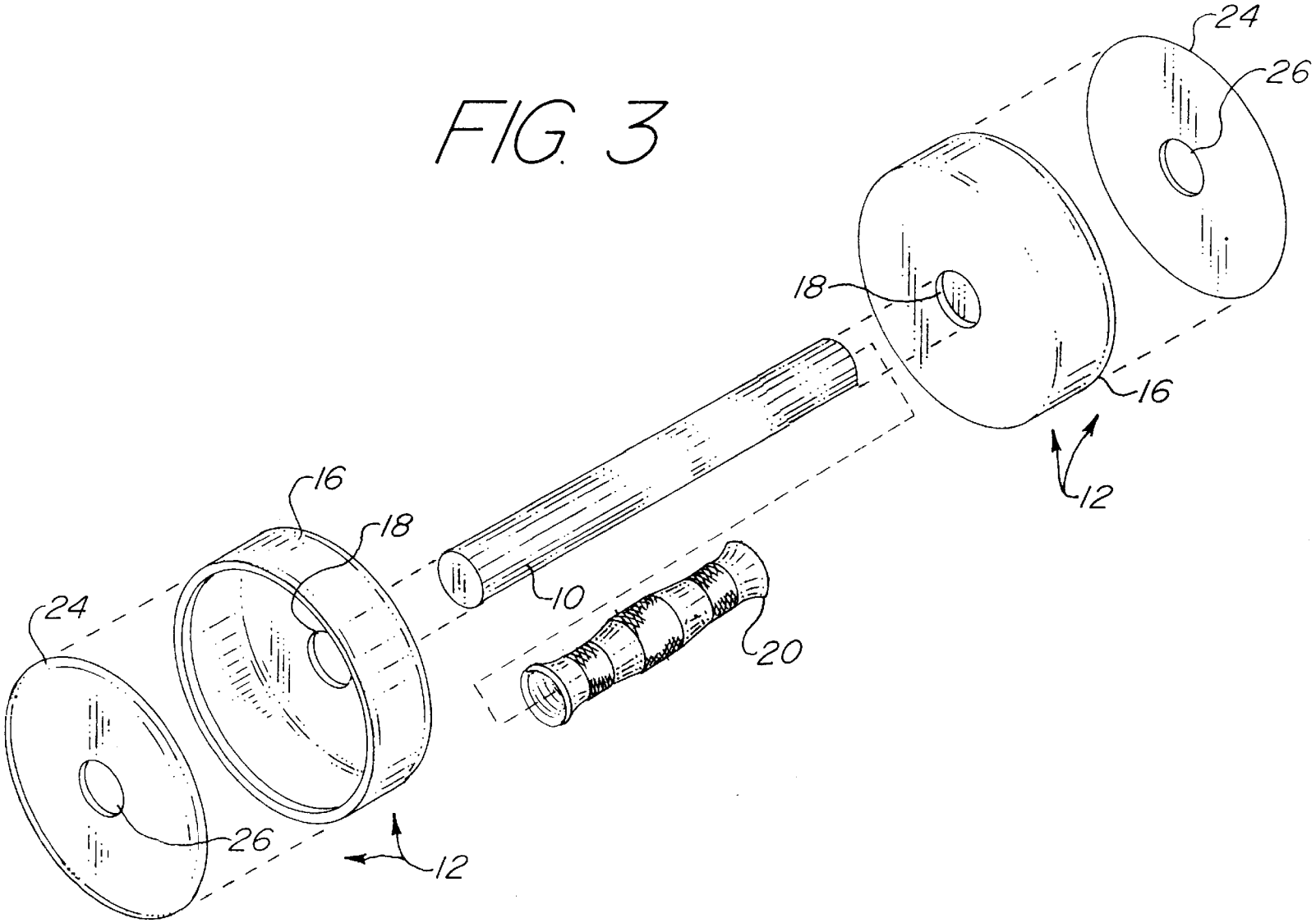
FIG. 3 is an exploded perspective view of the second preferred embodiment of the present invention.

As shown in FIG. 3, each weighted head 12 comprises a cup 16 that is generally cylindrical in shape with an open top. In the bottom of cup 16 is a cup hole 18 sized to receive one end of handle 10. To assemble the device, grip 28 may first be slid onto handle 10. Preferably, grip 28 is sized so that the fit with handle 10 is a tight compression fit. In this way, grip 28 will not spin on handle 10 during use. Next, cup 16 is slid onto handle 10 through cup hole 18 until shoulder 20 on grip 28 is reached. Cup hole 18 is smaller in diameter than shoulder 20 and thus shoulder 20 functions as a stop. In the preferred embodiment of FIGS. 2 and 3, the portion of handle 10 that passes through cup hole 18 extends just beyond the open end of cup 16. In the preferred embodiment of FIG. 1, the end of handle 10 is even with the lip of cup 16 after attachment. Cup 16 may be attached to handle 10 in any conventional manner, preferably by welding.

The toroidal cavity within cup 16 created by the insertion of handle 10 is filled with core material 22. Core material 22 is preferably a heavy metal, such as lead or mercury, that may be poured into cup 16 in a liquid form. Core material 22 fills cup 16 and, in the case of a solidifying material, also provides an additional bond between cup 16 and handle 10. In an alternative embodiment, powdered lead (or another powdered heavy metal) may be used as core material 22 to fill cup 16.

Once cup 16 is filled with core material 22, endcap 24 is attached to cup 16. Endcap 24 attaches at its edges to the lip of cup 16. In the preferred embodiment of FIGS. 2 and 3, one end of handle 10 extends through endcap hole 26 such that the end of handle 10 lies flat with the outer surface of endcap 24. In the preferred embodiment of FIG. 1, endcap 24 lacks endcap hole 26 and handle 10 only extends to the interior edge of endcap 24. Endcap 24 may be attached to cup 16, as well as the end of handle 10, by any conventional means, preferably by welding.

Once handle 10, grip 28, cups 16, and endcaps 24 are assembled, the entire device may be polished to remove any marks or rough edges due to welding or other attachment means. Protective coating 14 may then be applied to the weighted heads 12. Protective coating 14 may be applied in strips along the circumference of cups 16 to reduce cost.

The present invention has been described with reference to certain preferred and alternative embodiments which are intended to be exemplary only and not limiting to the full scope of the present invention as set forth in the appended claims.

We claim:

1. An exercise device comprising:

(a) a handle shaped as a bar;

(b) a plurality of heads attached to said handle, each of said heads comprising:

(i) a cup shaped as a cylinder with a circular bottom having an aperture therethrough and an open circular top and formed of a rigid, light metal wherein said handle is fitted through said aperture in said bottom of said cup and said cup is permanently attached to said handle;

(ii) a core formed of a heavy metal residing within said cup and completely filling the otherwise empty portion of said cup; and (iii) an endcap shaped as a circular disc the size of said open top of said cup and formed of a rigid, light metal wherein said endcap is welded to said open top of said cup, and wherein said cup and said endcap together completely enclose said core and permanently seal said core.

2. The exercise device of claim 1, wherein said cup is integrally attached to said handle.

3. The exercise device of claim 1, wherein said light metal comprises iron.

4. The exercise device of claim 1, wherein said light metal comprises steel.

5. The exercise device of claim 1, wherein said light metal comprises stainless steel.

6. The exercise device of claim 1, wherein said heavy metal comprises lead.

7. The exercise device of claim 1, wherein said lead is in powdered form.

8. The exercise device of claim 1, wherein said heavy metal comprises mercury.

9. The exercise device of claim 1, wherein said handle is a dumbbell handle.

10. The exercise device of claim 1, wherein said handle is a barbell handle.

11. The exercise device of claim 1, further comprising a resilient coating on said heads.

12. The exercise device of claim 11, wherein said resilient coating is applied to said heads in strips encircling said outer shell.

13. The exercise device of claim 11, wherein said resilient coating is rubber.

* * * * *